US005207421A

United States Patent [19]

Gorvin

[11] Patent Number: 5,207,421

[45] Date of Patent: May 4, 1993

[54] BALL TOSSING DEVICE WITH MAGAZINE

[76] Inventor: Frank A. Gorvin, 1 Lytton Road, Bournemouth, Dorset, United Kingdom, BH1 4SH

[21] Appl. No.: 865,695

[22] Filed: Apr. 8, 1992

Related U.S. Application Data

[63] Continuation of Ser. No. 602,237, filed as PCT/GB89/00367 on Apr. 11, 1989, abandoned.

[30] Foreign Application Priority Data

May 14, 1988 [GB] United Kingdom ..... 8811494

[51] Int. Cl.[5] ..... A63B 69/40

[52] U.S. Cl. ..... 273/26 R; 273/29 A; 273/129 W; 124/45; 124/49

[58] Field of Search ..... 273/1, 5 R, 26 D, 85 C, 273/85 E, 129 R, 129 V, 129 W; 124/7, 36, 47, 79, 45, 49

[56] References Cited

U.S. PATENT DOCUMENTS

| | | | |
|---|---|---|---|
| 719,719 | 2/1903 | Baynes | 273/85 E |
| 1,927,067 | 9/1933 | Manassero | 273/85 E |
| 4,186,927 | 2/1980 | Kluesza | 124/79 |
| 4,254,755 | 3/1981 | Morgan et al. | 124/7 |
| 4,262,648 | 4/1981 | Wagener | 273/26 D |
| 4,416,247 | 11/1983 | Yoshida | 124/79 |
| 4,583,743 | 4/1986 | Macek | 124/79 |
| 4,860,717 | 8/1989 | Powell et al. | 273/26 D |
| 4,907,802 | 3/1990 | Gatin | 273/26 D |

FOREIGN PATENT DOCUMENTS

| | | | |
|---|---|---|---|
| 170977 | 4/1952 | Fed. Rep. of Germany | 273/85 E |
| 24765 | of 1906 | United Kingdom | 124/79 |

*Primary Examiner*—Theatrice Brown

[57] ABSTRACT

A ball game practice unit has a striking unit provided in alternative positions for left and right-handed batters. A pivoted arm has a pad at one end which is struck downwardly to launch a ball upwardly for striking with a conventional bat. The unit has a magazine for storing several balls, a magazine extension for storing additional balls, and an insert for accommodating smaller balls. A magazine insert and an adjustably mounted ball stop on the other end of the pivot arm which allows the unit to launch balls of several different size.

6 Claims, 2 Drawing Sheets

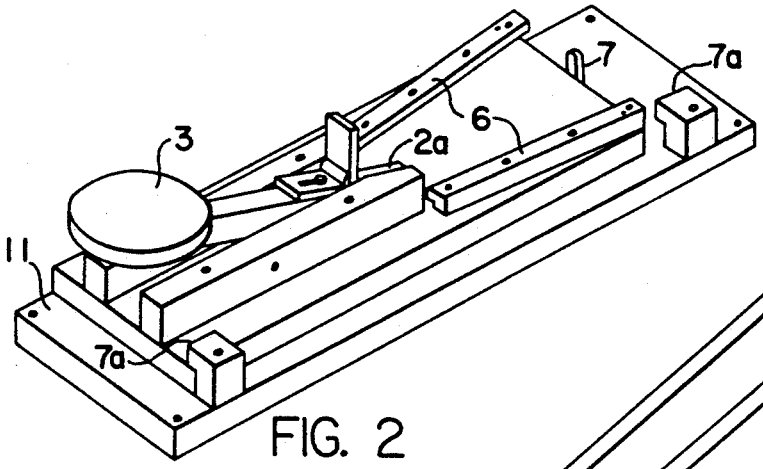
FIG. 2
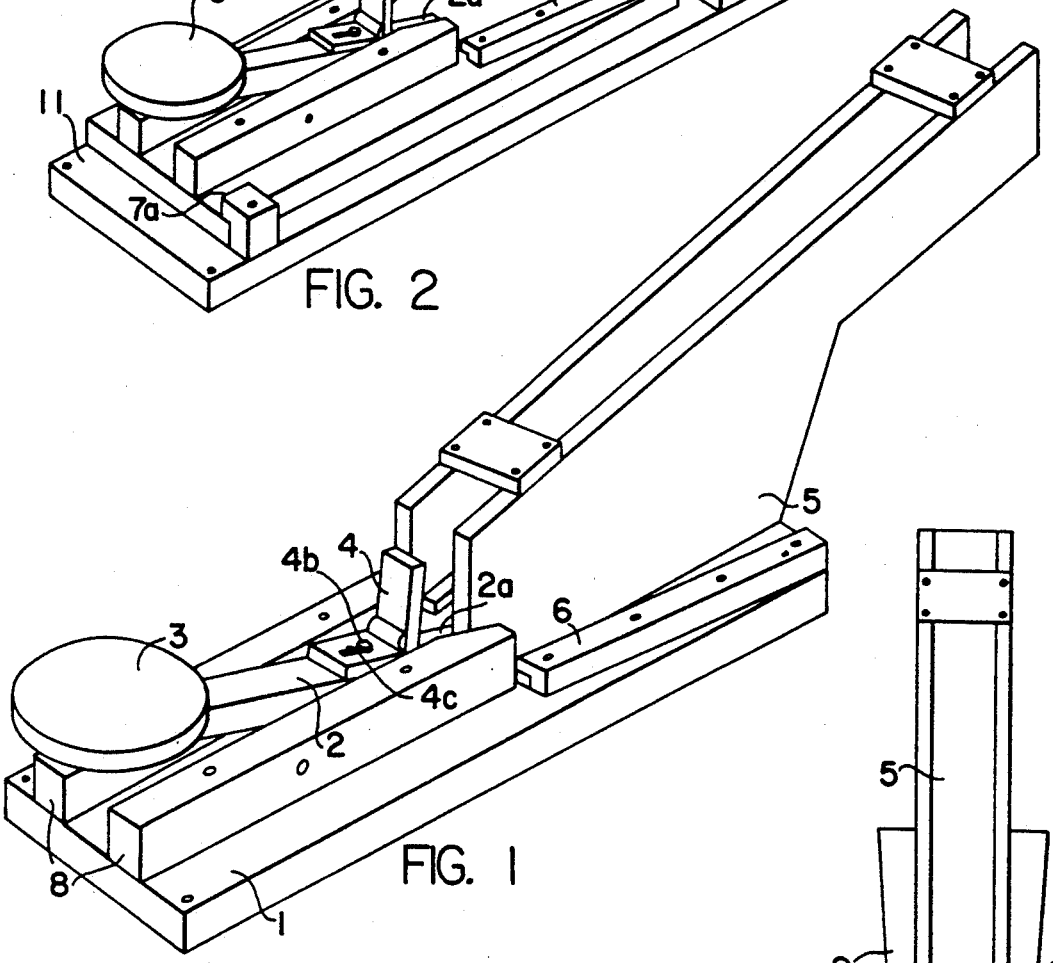
FIG. 1
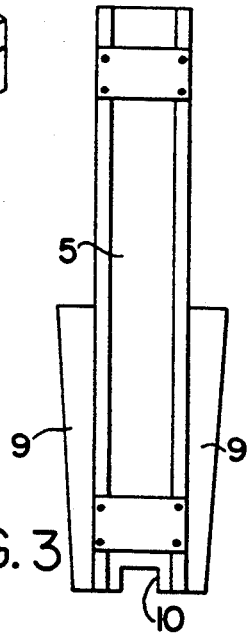
FIG. 3
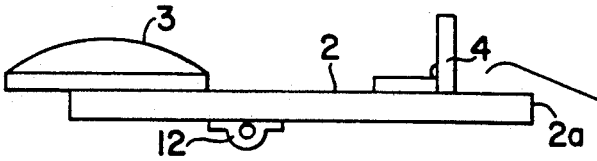
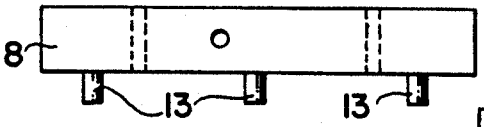
FIG. 4
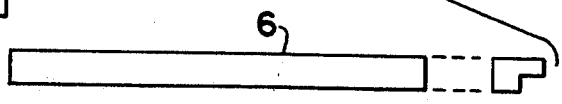
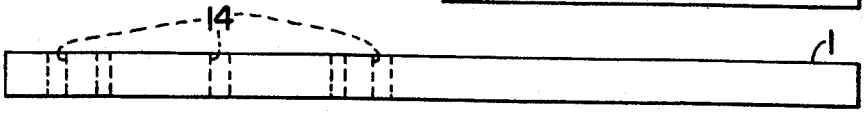

BALL TOSSING DEVICE WITH MAGAZINE

CROSS REFERENCE TO RELATED APPLICATION

This application is a continuation of Ser. No. 602,237 filed in the United States of America under the Patent Cooperation Treaty on Nov. 9, 1990 (now abandoned) and being based on an International Application filed in Great Britain and identified by Ser. No. PCT/GB89/00367 which in turn was based on an originally filed British application 8811494.7, filed May 14, 1988.

BACKGROUND OF THE INVENTION

This invention relates to ball games and is more particularly concerned with devices for projecting a ball into the air adjacent a player in order that the player may strike the ball with a bat. The device may also be used as an aid for practice, or as part of the game itself.

Devices are known where a batsman strikes a moveable arm to project the ball into the air, and then strikes the ball with the same bat. Some such devices have a magazine adapted to hold a number of balls so that one of these balls is advanced into a launching area each time that the arm is struck by the bat.

Known magazines are constructed to hold and to feed balls of a given diameter suitable for a particular game so that a different launching device is required for each size ball being used.

The chief object of the present invention is to provide a ball projecting apparatus having a magazine that may be readily adapted to hold and to feed balls of a number of different diameters as required for use or practice in a variety of ball games.

SUMMARY OF THE INVENTION

In accordance with the present invention a game ball projecting device includes a base, a striker unit mounted on the base in alternative left-hand and right-hand positions, said striker unit concluding a pivotable arm having one end adapted to be struck by a bat and a second end capable of imparting upward motion to a ball. A magazine is removably mounted on the base and is adapted to support a plurality of balls in an inclined chute such that the lowermost ball is provided above the second end of the arm. Finally, an adapter is provided for the magazine to provide for dispensing balls of different diameter.

BRIEF DESCRIPTION OF THE DRAWINGS

FIG. 1 is a perspective view of the striker unit and magazine.

FIG. 2 is a perspective view of the striker unit and the magazine provided on a base in one of two alternative positions.

FIG. 3 is a top plan view of the magazine illustrated in FIG. 1.

FIG. 4 illustrates the various components of the structure illustrated in FIG. 2 but in an exploded relationship.

DETAILED DESCRIPTION

Figure 5:
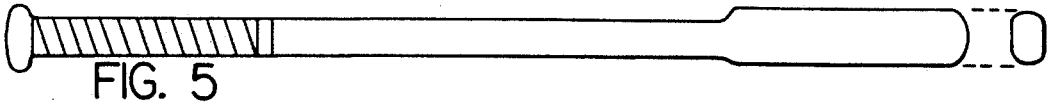
FIG. 5 shows a bat of the type adapted for use with the device of the present invention.

Referring more specifically to FIG. 2 a base or base plate 11 is provided on the ground and suitably secured in position so as to avoid any tendency to move about as a right-handed batter (not shown) strikes the pad 3 provided at one end of the pivoted arm 2. A second opposite end of the arm 2 is adapted to propel a ball (not shown) upwardly as a result of this striking action.

FIG. 1 illustrates a striker unit of the present invention without the base 11 and it should be noted that the unit of FIG. 1 can be reversed in position from that shown in FIG. 2, where it is suitably located for use by a right-handed batter, to an oppositely arranged position (not shown) where the unit can be used by a left-handed batter. The base 11 remains in the position shown during such shifting movement of the FIG. 1 unit itself. A locking lever 7 secures the plate 1 to the base 11, and also secures the magazine 5 in place. Stops *7a, 7a* also assist in securing the unit in these two positions.

As best shown in FIG. 4 the pivoted arm 2 is supported for limited rotation by the bearing 12 and is located generally between the spaced blocks 8, which blocks are secured to the plate 1 as for example by the dowel pins 13, 13. Suitable openings 14, 14 are provided in the plate 1 for receiving these dowels 13, 13. As best shown in FIG. 1 the magazine 5 is slidably secured between L-shaped locating rails 6, 6 which locating rails are adapted to engage the shoulders 9 (FIG. 3), 9 provided for this purpose at the lower edge of the magazine 5. A recess 10 is provided in the magazine to accommodate the second end 2*a* of the pivoted arm 2. A spring (not shown) may be provided between the end of the arm associated with the pad 3 and the plate 1 so as to assure that the pivoted arm returns to the position shown after being struck by the batter. An L-shaped stop 4 on the arm 2 assures that the lowermost ball is properly positioned for launching. A screw 4*b* in the slot 4*c* permits this stop to be adjustably clamped to the arm 2.

Figure 7:
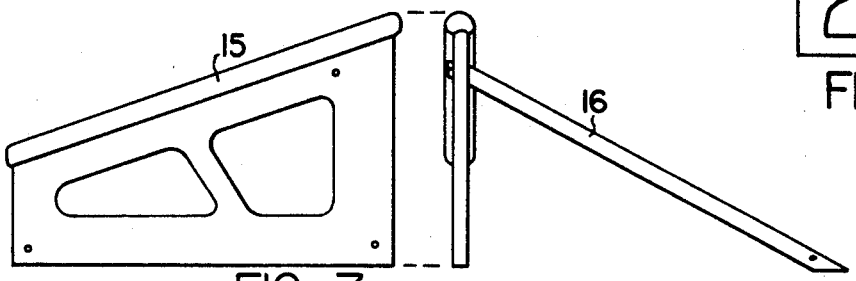
FIG. 7 shows a shield which can be used for safety purposes during practice with a device of the present invention.

FIG. 7 shows a padded shield which may be used adjacent to the device of the present invention and held in place by a support 16. The shield is preferably padded at the top so as to deflect the bat when as a result of an errant swing at a ball, the batter misses the pad 3.

Figure 6:
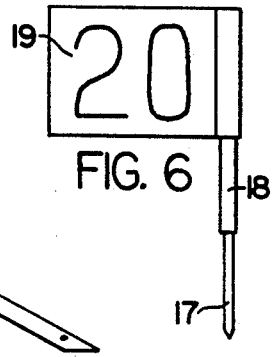
FIG. 6 shows a side line flag for marking the field of play on which a device of the type shown in FIGS. 1–4 might be utilized.
Figure 10:
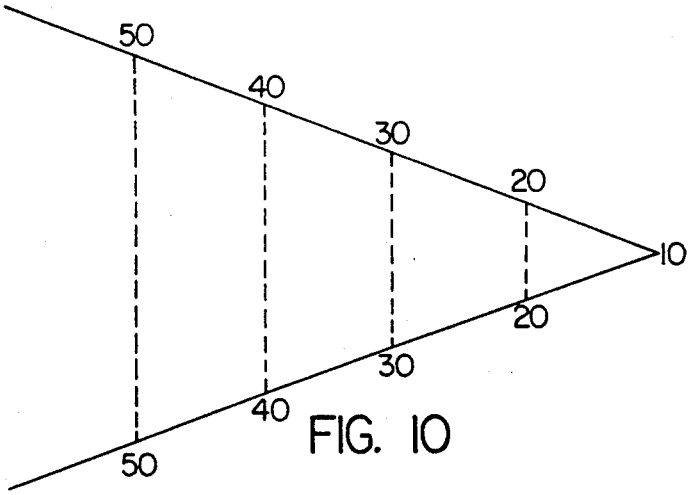
FIG. 10 shows the field of play where the device would be adapted for use at the vertex of the two side lines.

FIG. 6 shows a flag of the type adapted to be provided in the ground along the side lines illustrated in FIG. 10 at suitable distances from the vertex 10 of these side line marks. It will be apparent that the device of the present invention is adapted to be provided at the vertex 10 of the side lines so that the batter can strike the pad 3 causing the ball to rise upwardly from its launching site in the device of the present invention whereupon the batter swings horizontally at the ball in order to drive the ball between the side line markers of FIG. 10.

Figure 8:
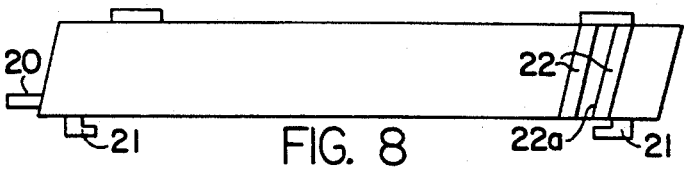
FIG. 8 shows a magazine extension adapted for use with the magazine of the present invention.

FIG. 8 shows a magazine extension having locating pegs 20 provided at one end for locating the extension at the end of the magazine 5. The bottom of the magazine extension of FIG. 8 is provided with lugs 21, 21. Each lug 21 is adapted to receive an elastic band (not shown) for releasably securing one end of the magazine extension to the magazine.

Figure 9:
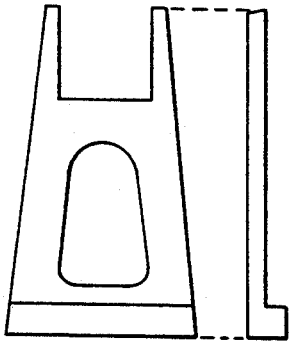
FIG. 9 shows a support for the magazine extension of FIG. 8.

FIG. 9 shows a support for the other end of the magazine extension of FIG. 8 and it will be apparent that the upper end of the support of FIG. 9 is bifurcated to receive the magazine of FIG. 8. More specifically, parallel ribs 22, 22 in the other end of the magazine extension of FIG. 8 define a slot therebetween for receiving the bifurcated upper end portion of this FIG. 9 support.

Figure 11:
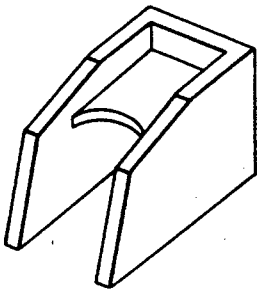
FIG. 11 is a perspective view of an adapter insert which can be fitted into the lower end of the magazine to accommodate balls of smaller diameter, and which will locate the lowermost ball for launching with the striker unit.

FIG. 11 shows an adapter which is slidably received in the lower end of the magazine 5 whereby to reduce the inside dimension of the magazine from that which will receive relatively large style balls to a width that is more suitable to a smaller size ball. For example, a soft ball of larger diameter might be used for practice whereas the smaller width adapter will permit use of a conventional cricket ball or hard ball. Other balls might be fitted in the magazine of the present invention by use of other adapters (not shown) such that other size balls can also be accommodated in utilizing the apparatus of the present invention.

I claim:

1. A game ball projecting device for batting practice comprising a base, and a ball striker unit, means for mounting said ball striker unit on said base for alternative use by left-hand and right-hand batters, said striker unit includes a pivotable arm having a first end adapted to be struck by a bat and a second end for imparting upward motion to a ball, a magazine capable of holding a plurality of balls having a predetermined, said balls being arranged in said magazine in a predetermined order for positioning a lowermost ball in the magazine above said second end of the pivoted arm, and insert means for the magazine for dispensing balls of a different diameter than said predetermined diameter.

2. The device as defined in claim 1 wherein means is provided for latching said striker unit to said base.

3. The device as defined in claim 1 a ball stop provided on the movable arm adjacent said second end, said stop being adjustable on said arm to accommodate balls of different diameter.

4. The device as defined in claim 1 wherein said magazine is releasably secured to said striker unit.

5. The device, as defined in claim 1, wherein a magazine extension is provided for said magazine, said extension provides for holding additional balls to permit a user of the device to practice a longer period of time prior to reloading.

6. The device, as defined in claim 1, further includes a bat deflector shield, said deflector shield having an inclined surface and being functional to deflect a low swinging bat upwards and away from said first end of said pivot arm.

* * * * *